US005685376A

United States Patent [19]

Tirronen et al.

[11] Patent Number: 5,685,376

[45] Date of Patent: Nov. 11, 1997

[54] SYSTEM AND METHOD UTILIZING LOW-PRESSURE NOZZLES FOR EXTINGUISHING FIRES

[76] Inventors: Hannu Tirronen, Kukonharjantie 2, FIN-21410 Vanhallinna; Pekka Salmi, Kuusimäentie 4, FIN-21290 Rusko, both of Finland

[21] Appl. No.: 628,696

[22] PCT Filed: Sep. 9, 1994

[86] PCT No.: PCT/FI94/00395

§ 371 Date: May 20, 1996

§ 102(e) Date: May 20, 1996

[87] PCT Pub. No.: WO95/11060

PCT Pub. Date: Apr. 27, 1995

[30] Foreign Application Priority Data

Oct. 19, 1993 [FI] Finland ..... 934617

[51] Int. Cl.[6] ..... A62C 35/68

[52] U.S. Cl. ..... 169/46; 169/5; 169/16; 169/70; 239/488

[58] Field of Search ..... 169/5, 16, 37, 169/46, 47, 70; 239/487, 488

[56] References Cited

U.S. PATENT DOCUMENTS

| | | | |
|---|---|---|---|
| 2,283,775 | 5/1942 | Thompson | 169/46 |
| 2,292,794 | 8/1942 | Paradise | 169/46 |
| 2,699,217 | 1/1955 | Elmenhorst | 239/488 X |
| 3,684,019 | 8/1972 | Emmons et al. | 169/47 |
| 3,934,823 | 1/1976 | Reed | 239/472 |
| 4,142,682 | 3/1979 | Bowen | 239/488 |
| 4,570,860 | 2/1986 | Aprea et al. | 239/478 |

FOREIGN PATENT DOCUMENTS

WO 92/22353 12/1992 WIPO .

*Primary Examiner*—Andrew C. Pike
*Attorney, Agent, or Firm*—Nixon & Vanderhye P.C.

[57] ABSTRACT

It is possible to more effectively extinguish fires in confined spaces such as engine rooms of ships. General nozzles are disposed above and/or on the sides of the confined space to be protected for general fire extinguishment in the confined space. Spot nozzles may be disposed around specific objects which are susceptible to fire in the confined space, such as engines in an engine room. At least some of the nozzles are low pressure nozzles having wings from which extinguishing water is sprayed at a pressure less than twelve bar, e.g., between 2–12 bar, having water droplets of various size. Due to rotating action of the wings, the water droplets are distributed in the water spray so that the frequency of drops having larger diameters is greater at the periphery of the water spray than in the inner part of the spray, and correspondingly, the frequency of drops having smaller diameters is greater in the inner part of the spray than at the periphery.

20 Claims, 2 Drawing Sheets

SYSTEM AND METHOD UTILIZING LOW-PRESSURE NOZZLES FOR EXTINGUISHING FIRES

BACKGROUND AND SUMMARY OF THE INVENTION

The present invention relates to a method and a system for extinguishing fires in confined spaces, such as engine rooms, of ships, distribution substations, hotel rooms or open oil tanks. The invention relates to a fire extinguishing system comprising general nozzles disposed above and/or on the sides of the space to be protected for bringing about general fire extinguishment in the space, and/or spot nozzles disposed around objects in the space to be protected which are susceptible to fire, such as engines, feed pipe systems for fuel, or open oil tanks, for extinguishing fires in them. The fire extinguishing system thus corresponds to a so-called sprinkler system. The invention also relates to a fog spray nozzle which is suited for use in the fire extinguishing system.

Conventional sprinkler fire extinguishing installations, in which the extinguishing agent consists of water, comprise a water pipe system disposed in the ceiling and possibly on the walls of the room. In case of fire, the nozzles disposed in the pipe system are released and the pressurized water flows in form of sprays from the nozzles into the room. In order to ensure extinguishment of the fire, the amount of water flowing from the nozzles is usually dimensioned to be many times larger than the amount needed. Because of that, the damage caused by water in connection with small fires is often greater than the damage caused by the fire itself. In sprinkler systems large amounts of water are usually sprayed outside the actual seat of fire or the hot flames, wherefore this water does not evaporate. Also plenty of water has to be used for extinguishment of smouldering fires. Extinguishment of fire by water is especially problematic in spaces containing electric equipment.

It has been found that the smaller the drops of the extinguishing water, the greater the heat absorption capacity of the drops, i.e., the better the cooling effect of the water. It is also known that the penetration capacity of small water drops into the burning material, for instance textiles, is better than that of large drops. Therefore fog sprays in which the diameter of the drops is somewhere between 0.1 and 1 mm have been used for extinguishment of fire. The small drops are produced with nozzles by changing the pressure. In high-pressure fog sprays, even smaller drop sizes than the above-mentioned are used.

The drawback of a small drop size is, however, that with a low pressure, i.e., <10 bar, these small fog drops do not easily penetrate into the seat of fire. If a water fog consisting of small drops is directed directly to the seat of fire at low pressure, the flames of the fire and the water vapour which is produced tend to push the fog away from the seat of fire, whereby the cooling and extinguishing effect will be small. A sufficient spray length has, for the above-mentioned reasons, not yet been achieved with a conventional low-pressure fog spray consisting of small drops. Thus, when extinguishing fires with low-pressure fog sprays, much more water and a longer extinguishing time is needed than when a larger drop size is used. Despite the advantages of the small drop size, it has not been possible to utilize this in a desired manner.

Efforts have been made to find a solution to this problem by raising the pressure of the fog spray to a high level, for instance in the method according to International Patent Publication No. WO 92/22353 to a pressure even above 200bar. A fog sprayed at a too high pressure will however pass very rapidly directly through the flames, wherefore its cooling effect will not be fully utilized.

When using high-pressure sprays, the idea is to smother the fire by force by means of a high-pressure water layer. The surplus water evaporates, spreads to the sides and fills the site of fire with steam, which causes trouble for the firemen. An additional drawback when extinguishing fires with high-pressure sprays is that the spray, when directed to an open liquid tank, such as an oil tank, spreads the liquid into the surrounding area thus increasing the risk of the fire spreading.

The expensive pressure accumulator and other equipment needed for the pressurization naturally add to the cost of the pressurized system.

Instead of extinguishment by water, also other fire extinguishing systems have been suggested, such as $CO_2$ and Halon extinguishing systems, by means of which a fire can be efficiently extinguished and water damage avoided. A poisonous $CO_2$ gas extinguishing system, in which the fire is smouldered by $CO_2$ gas, can however be used only in such spaces in which there are no people or animals during the extinguishment of the fire. Halon as such is not dangerous to people and very small amounts of Halon is needed for the extinguishment of a fire. At high temperatures, the Halons produce, however, highly poisonous compounds and can therefore be dangerous to use in fires. The Halons have furthermore been found to have harmful effects on the atmosphere.

The object of the present invention is to provide a new fire extinguishing system as well as a fire extinguishing system corresponding to the sprinkler system, and a fire extinguishing nozzle, in which the above-mentioned drawbacks are minimized.

The object of the invention is especially to provide a new fire extinguishing system by means of which a fire can be efficiently and rapidly extinguished by water sprays without using excessive amounts of water.

The object of the invention is furthermore to provide a new and simple fire extinguishing system at low initial cost.

The above-mentioned objects of the invention are achieved by a method, a fire extinguishing system, and a nozzle according to the present invention.

In the fire extinguishing system according to the invention, at least a portion of the nozzles consists of low-pressure nozzles, from which extinguishing water is sprayed at low pressure, preferably at a nozzle pressure below 10 bar and most preferably 2–12 bar. The extinguishing water is sprayed as a fog spray, which essentially consists of drops of various sizes. The diameter of the drops varies substantially between 0.1 and 1 mm, preferably between 0.2 and 0.5 mm.

In the system according to the invention, the fog spray is supplied from a nozzle by means of wings disposed in it, preferably so that the spray is discharged as a, at least partly, rotating conical spray, or so that the spray progresses turning helically around its main axis.

In this way the drops can be caused to be distributed so that a denser layer of large water drops is formed at the conical outer surface of the water spray than inside, in the midpart of it. Correspondingly, in the inner part of the water spray, in the middle of flow, a denser layer of small water drops is formed than at the conical outer surface. The drops are thus distributed in the water spray so that the frequency of the drops having larger diameters is greater at the periphery of the water spray than in the inner part of it, and correspondingly, the frequency of the drops having smaller diameters is greater in the inner part of the water spray than at its periphery.

The low-pressure nozzles are preferably arranged to spray extinguishing water as drops having a diameter of 0.1–1 mm, preferably 0.1–0.5 mm. The median size of the diameter of the drops increases from the inner part of the spray to the periphery by at least 20%, preferably by more than 50%. For instance the following median drop sizes have been measured in a system according to the invention: diameter of the drops in the peripheral zones of the spray 0.25–0.35 mm and in the middle of the spray 0.15–0.25mm.

A favorable distribution of the drop size is brought about by spraying extinguishing water by means of low-pressure nozzles in which there are guide wings for causing the spray to emerge from the nozzle as a fog spray rotating substantially around the axis of its own direction of flow.

The larger drops of the spray will then accumulate at the surface of the spray and the smaller drops in the middle of it. The period of rotation of the drops in the peripheral zones of the spray is relatively long so that the spray does not impinge on the object of fire with great force. The large drops accumulate in the peripheral zones and encounter the oncoming, upward flowing gases. The small drops stay protected inside the spray and do not escape therefrom.

In the fire extinguishing system according to the invention, the water spray is discharged at a high velocity from the nozzle and immediately forms drops, but slows down due to the rotary movement of the drops as the drops move downwards, away from the nozzles. In the system according to the invention the spray moves slower than a corresponding spray of a high-pressure system, wherefore the spray has more time to perform the fire extinction. The object of the system according to the invention is to cause as large a portion of the water as possible to evaporate, thus making the best use of the water and minimizing the damage caused by it.

Thus, the low-pressure nozzle according to the invention comprises a nozzle body having an inlet opening for extinguishing water, a nozzle chamber and a discharge or spraying opening for extinguishing water. Inside the nozzle chamber is disposed at least one, and preferably two, guide wings which guide the extinguishing water into a movement progressing rotatingly around its axis, whereby, when the extinguishing water spray is discharged, the larger drops of the extinguishing water tend to accumulate at the periphery of the conical extinguishing spray, whilst the smaller drops of the extinguishing water accumulate in the inner part of the extinguishing water spray.

The fire extinguishing system according to the invention brings about a rapid temperature drop of the combustion gas and prevents reignition of the fire. The small fog spray drops are conveyed, carried by the larger drops, as an efficiently penetrating spray directly into the seat of fire. The large drops penetrate because of their size normally better than the small through the combustion gas layer. In the system according to the invention the large drops entrain, due to their weight, the small drops through the combustion gas layer.

In the system according to the invention, 0.5–1.5% of a reignition-preventing substance, such as monoammonium phosphate, ammonia, and/or urea, is preferably added to the extinguishing water. The reignition-preventing substance, such as monoammonium phosphate, forms a film on the object of fire which prevents the pyrolysis gases being produced at the site of fire from combining with the oxygen of the air, thus preventing reignition of the fire. In fires in homes, the additive forms a film around the fibers of the furnishing fabrics preventing them from reignition at the high temperature. The film-forming additive facilitates especially the extinguishment of burning liquids by forming a film on the surface of the liquid, which prevents the oxygen from combining with the liquid. Other additives, such as ammonia, can be added to the extinguishing water in order to increase its cooling effect. The additives absorb heat when they evaporate. Furthermore, ammonia raises the pH to a value >7, whereby the corrosion effect of the water is reduced. The above-mentioned additives mixed with water to make a weak solution do not cause any harm to people or the environment.

As extinguishing water in the fire extinguishing system of a distribution substation, is used salt-free water, such as distilled water, is used to which is preferably added 0.5–1.5% of a reignition-preventing substance. The electric resistance of distilled water is over 100 k-ohm/cm.

The extinguishing water spray is preferably supplied from the general nozzles or the spot nozzles in the way that the water spray cannot form foam in or near them. A thin layer of foam is formed only when the extinguishing water has reached the burning object.

The nozzles belonging to the fire extinguishing system according to the invention are stationarily installed and preferably so that the extinguishing water sprays fully cover desired parts of the objects susceptible to fire. Furthermore, at least a portion of the low-pressure nozzles are disposed so that the sprays coming from the nozzles during the fire are directed to the vacuum side of the flames which are produced, whereby extinguishing water is sucked from the spray into the flames, thus extinguishing them.

In the system according to the invention, the general as well as the spot nozzles spray extinguishing liquid at a pressure of less than 10 bar, preferably 2–12 bar. About 3–18 1/min extinguishing liquid is supplied from the general nozzles. The spot nozzles are disposed at such a distance, for instance at a distance of 0.5–1.5 m from the object susceptible to fire, that the extinguishing liquid is capable of penetrating into a desired point in the flames, but does not pass too rapidly through the flames without efficiently extinguishing the fire. About 4 –16 1/min of extinguishing liquid is supplied from the spot nozzles.

The spot nozzles spray water drops preferably having a diameter of 0.18–0.5 mm, which absorb heat efficiently and are capable of penetrating through the flames to the object or, supplied on the vacuum side, are sucked into the flames.

The fire extinguishing system is designed so that the objects specially susceptible to fire, i.e, those parts of the room where a fire most likely would start, are covered. In the engine room of a ship, the fuel pipes, in which the pressure can be up to 150 bar, are for instance such an object; a leakage there can cause a spray fire, i.e., a spraying flame, which must rapidly be extinguished.

The spot nozzles of the fire extinguishing system in the engine room are preferably disposed so that they fully cover the high-pressure fuel pipe system in the vicinity of the engine. Furthermore, it should preferably be ensured that in case of fire at least one spot nozzle supplies extinguishing liquid to the vacuum side of the flames. It is usually difficult to anticipate the direction of the flames and therefore spot nozzles should be disposed around the object susceptible to fire in the way that every possibility is taken into account, i.e., that a slightly larger area than the object in question is covered by the spot nozzles. In case of a fluid pipe system, the spot nozzles should be disposed at a suitable distance apart from each other along the pipe and additionally one more spot nozzle should be placed outside either end of the pipe.

As nozzles for the fire extinguishing system, are preferably nozzles used which spray extinguishing liquid covering a large angle, about 40°–125°, depending on the type of nozzle. The smaller the pressure of the water or water/additive liquid discharged from the nozzle is, the larger the angle should be. At a pressure of 6 bar, for instance, the extinguishing liquid can be sprayed covering an angle of 100°–105° and at a pressure of 2 bar covering an angle of 115°–120°.

The fire extinguishing system according to the invention can be implemented for instance as a dry system, i.e., so that in the water extinguishment pipes there is normally not water but air. In case of fire, the fire extinguishing system is set in operation either automatically released or by pushing a start switch, whereby the pump or pumps connected to the storage tank for the extinguishing liquid are started and feed extinguishing liquid to the pipe system. It can often be advantageous to have separate pumps for the pipe systems for the general nozzles and the spot nozzles. This means that instead of one large and expensive pump, two small pumps, the total cost of which is considerably smaller, are used. Furthermore, the pressure of the nozzles used for the general extinction and that of the spot nozzles can be adjusted independently of each other.

To mention some of the advantages of the fire extinguishing system compared with a $CO_2$ sprinkler system:

- it can safely be released on people;
- it can be carried out as an automatic system as there is no danger to people;
- low pressures are used in the system, i.e, <12 bar, consequently expensive pumps and pressure pipes are not needed;
- the extinguishing matter is cheap;
- it can safely and cheaply be released for testing purposes;
- it can be serviced easily and cheaply;
- no pressure tanks are needed in the system.

The system according to the invention can also replace the Halon extinguishing systems, which should be avoided because of their danger to the environment.

The advantages of the fire extinguishing system compared with other known water extinguishing systems are for instance:

- a low-pressure system in which large drops are used for conveying light, small drops to the object of fire, but not directly through it:
- the good penetration of the small fog drops into a spraying flame;
- a good extinction capacity;
- a low-pressure system, which is cheaper and easier to install than known high-pressure systems;
- an optimally combined cooling of the site of fire by water and prevention of reignition by means of an additive;
- small amounts of extinguishing water, as the nozzles are directed so that the water sprays are utilized optimally. In conventional sprinkler systems, about 5 liters of extinguishing water per $m^2$ of protected area are used. In the system according to the invention 0.3–6 $l/m^2$, depending on the nozzle type, is sufficient, in some cases even as little as 1/10 is used compared with the amount of water used in a conventional system;
- the damage caused by water is considerably smaller than in conventional sprinkler systems;
- the aftereffects of the extinction are also smaller as the pH value of the extinguishing liquid is about 7 and its corrosion effect is small;
- circulation of water in the pipes is not needed, and
- the salt-free water consisting of small drops at low pressure does not cause damage to the electric equipment.

The fire extinguishing system according to the invention functions for instance as follows: In case of fire, the starting switch of the fire extinguishing system is pushed, whereby the pump or pumps are set in motion and suck extinguishing water from the tank. An additive preventing reignition of the fire is in advance added and mixed into the tank. The additive is emulsified in the water. The additive can, if desired, be added to the flowing extinguishing water by means of an ejector after the pump has been started. The extinguishing water is pumped from the general nozzles and the spot nozzles to the object which is to be protected.

The extinguishing water (the extinguishant) discharged from the general nozzles cools the room and extinguishes the fire in it. The water discharged from the spot nozzles is directed to the seat of fire and the root of the flames, preferably via the low pressure side of the flames, whereby it efficiently cuts the flames. The extinguishing water discharged from the general nozzles sprayed without any high pressure as small and large drops of various sizes is also sucked with the combustion air into the seats of fire, thereby extinguishing the flames and cooling the seats of fire. As many spot nozzles as in a conventional fire extinguishing system are not therefore needed in the system according to the invention. The additive forms a film on the hot surfaces which prevents the pyrolysis gases and the oxygen of the air from combining with each other and prevents reignition of the fire.

BRIEF DESCRIPTION OF THE DRAWINGS

The invention is described more in detail in the following with reference to the accompanying drawings, in which.

DETAILED DESCRIPTION

Figure 1:
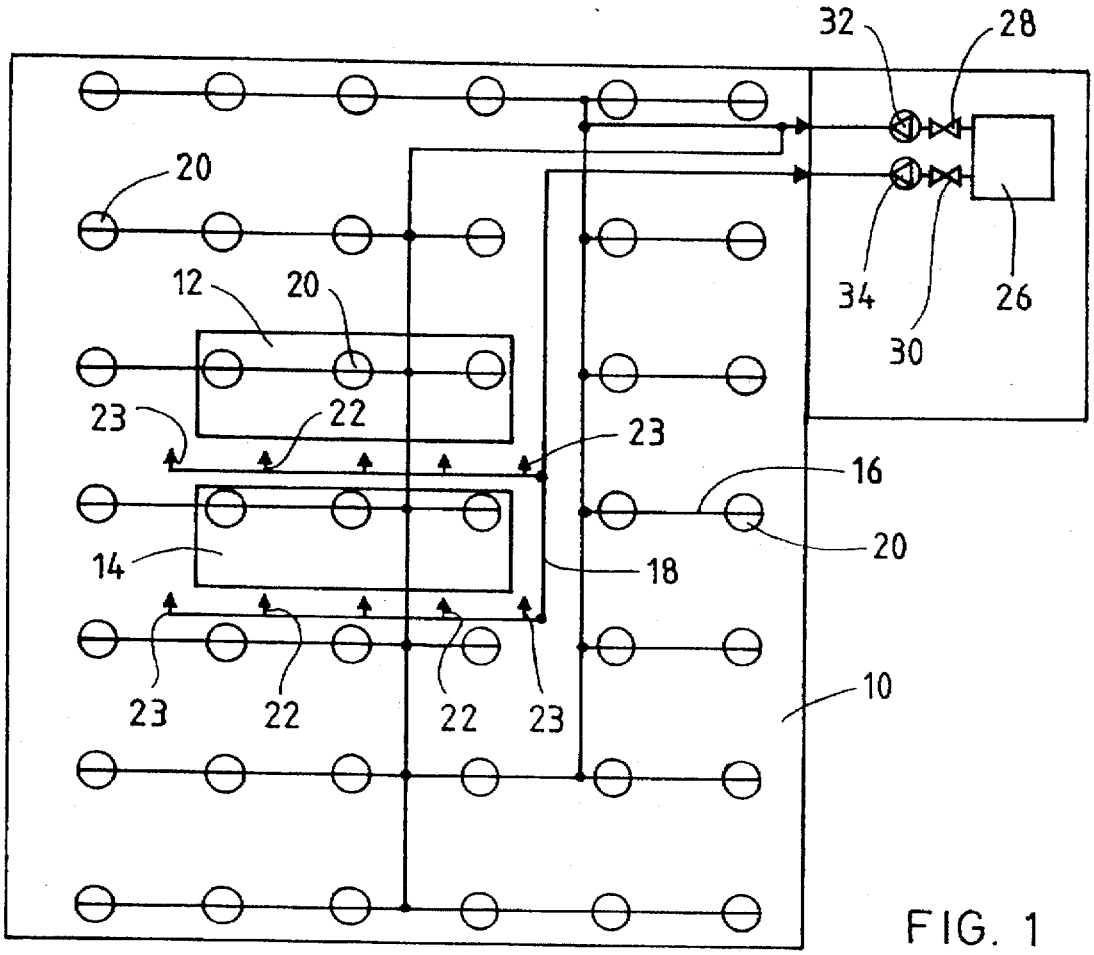
FIG. 1 is a schematic plan view of a fire extinguishing system according to the invention disposed in the engine room of a ship.

FIG. 1 shows an engine room 10 of a ship having two main engines 12 and 14. In the engine room there is a general fire extinguishing pipe system 16 installed in the ceiling and a spot fire extinguishing pipe system 18 installed in connection with the main engines. General nozzles 20 are disposed at equal distances from each other in the general extinguishing pipe system so that the whole room can be covered by the water sprays discharged from them. Spot nozzles 22 are disposed in the spot extinguishing pipe system. In the arrangement shown in FIG. 1, the general extinguishing pipe system 16 and the spot extinguishing pipe system 18 consist of two separate pipe systems.

Figure 2:
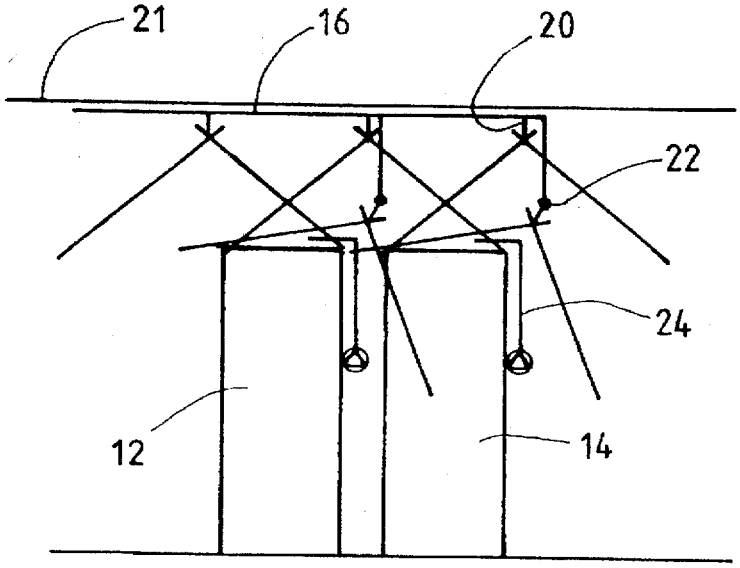
FIG. 2 is a vertical sectional view of the fire extinguishing system of FIG. 1.

FIG. 2 shows the general extinguishing pipe system 16 with its general nozzles 20 located above the main engines 12 and 14 near the ceiling 21 and the spot nozzles 22, which are located at a lower level than the general nozzles 20. The spot nozzles 22 are disposed near the main engines 12, 14 so that they are capable of spraying water to all parts of the engines. The nozzles are in particular arranged so that a fire caused by damage to the high-pressure fuel pipes 24 can be extinguished. The high-pressure fuel pipes 24 are entirely covered by the sprays from the spot nozzles 22. A portion of the spot nozzles 23 are, as seen in FIG. 1, located so that water can be sprayed from them into the space surrounding the fuel pipe system, i.e., so as to ensure that extinguishing liquid will be sucked into the flames in all parts of the fuel pipe system.

The general nozzles 20 can be disposed in the ceiling or elsewhere above the main engines about 1.5–3 m apart from each other. They are preferably staggered so that the water sprays discharged from the nozzles entirely cover the horizontal cross section area of the engine room above the objects to be protected. The spot nozzles 22 can be arranged 0.3–0.7 m, preferably about 0.5 m, apart from each other. The optimal distances between the nozzles depend on the distance from the nozzle to the object to be protected and the size of the angle of the spray discharged from the nozzles.

FIG. 1 also shows an extinguishing liquid tank 26 located outside the engine room and pumps 32 and 34 connected to the tank through valves 28, 30, by means of which the extinguishing liquid is fed to the pipe systems 16 and 18. The concentrated additive, which is mixed into the extinguishing water, may consist of 10–30%, preferably 16–21% ammonium phosphate, 1–5%, preferably 2.5–3.5 ammonia, 1–5%, preferably 3–4% urea and the rest of it water. The concentrate is mixed into the extinguishing water so that the content of concentrate in the water is 2–7%, whereby the content of ammonium phosphate in the water is about 0.5–1.5%.

Figure 3:
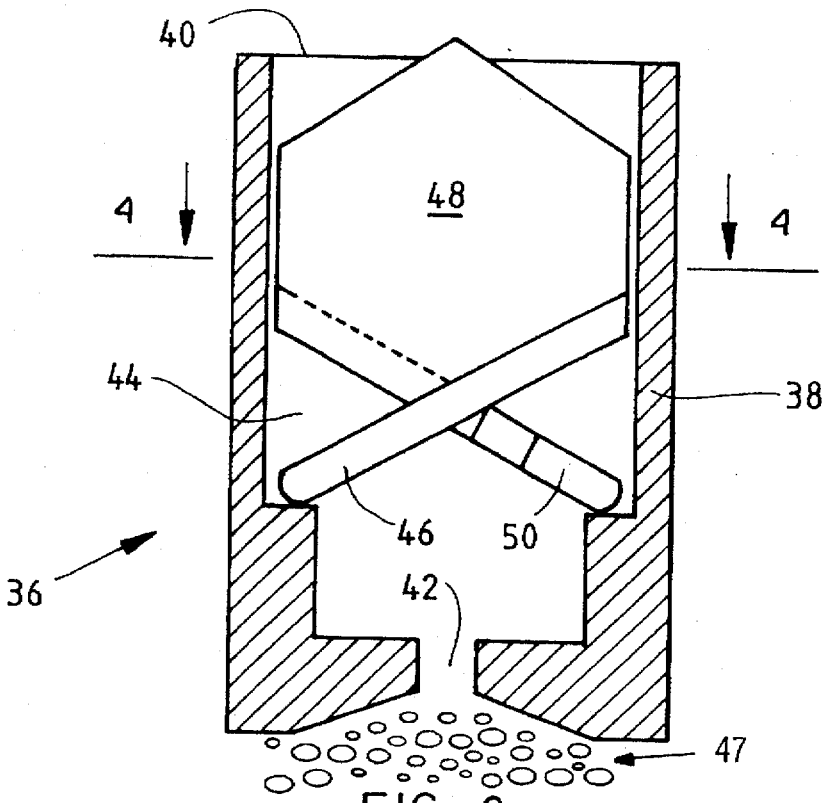
FIG. 3 is a schematic vertical view, partly in section, of a low-pressure nozzle according to the invention.
Figure 4:
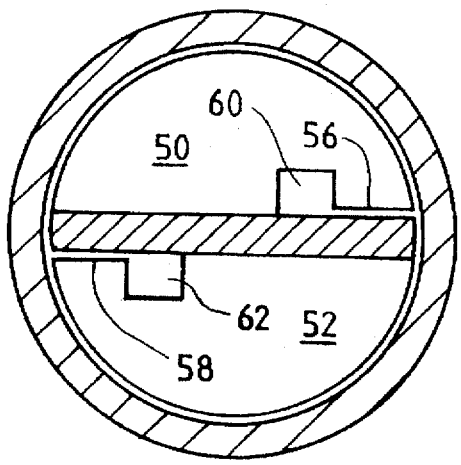
FIG. 4 is sectional view of FIG. 3 taken along line 4—4.

FIGS. 3 and 4 show a low-pressure nozzle 36 which is used in the system according to the invention. The nozzle comprises a cylindrical body 38 having an inlet opening 40 and a discharge opening 42. A guide element 46 for the water is disposed in the nozzle chamber 44. The guide element comprises a vertical support plate 48, the width of which is substantially the same as the diameter of the nozzle chamber, and two oblique wings 50 and 52 in the discharge end of the nozzle chamber. The wings have a substantially semicircular form and their joint projection on a horizontal plane corresponds to the cross section of the nozzle chamber, as can be seen in FIG. 4.

Figure 5:
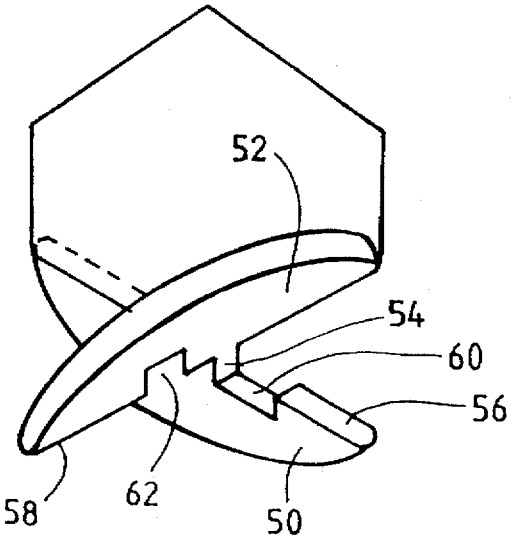
FIG. 5 is a view of the wings of the nozzle seen obliquely from below and the side.
Figure 6:
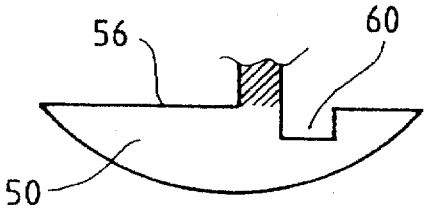
FIG. 6 is a view of the other wing of FIG. 5 seen from below.

The wings are, as can be seen in FIG. 5, attached by a neck 54 to each other and the support plate, substantially at the middle of the circular curves. Openings 60 and 62 are formed in the lower parts of the straight sides 56 and 58 of the wings. The water flows along the wings underneath them, thereby bringing about a rotating movement.

Thus, the support plate 48 divides the flow of water coming from the inlet opening into two parts. The two flow parts are guided by the wings 50 and 52 downwards to the opposite sides of the nozzle chamber 44 and over the edges of the lower end of the straight sides 56 and 58 and through the openings 60 and 62 to the lower side of the wings. Below the wings two successive sprays are formed, for instance flowing clockwise, which are discharged from the nozzle as an at least partly rotating spray. The spray consists of drops of various sizes, which are oriented in the spray according to their sizes.

The water spray drops fall down in a uniform front from the nozzles arranged for instance in the ceiling. The larger drops entrain smaller drops, which absorb heat from the surroundings. The large drops, which are usually better capable of penetrating into the seat of fire, entrain in the system according to the invention the small drops even through the layer of combustion gases to the seat of fire. In the seat of fire, the small drops have a better penetrating capacity as big drops. An exemplary fog spray according to the invention is shown schematically at 47 in FIG. 3.

The fire extinguishing system according to the invention is, due to its high fire extinction capacity, well suited for extinguishing fires of most various kinds. The fire extinguishing system can even be used for extinguishing burning napalm or molten metals.

The invention is not restricted to the above described and illustrated embodiment, but can be applied within the scope of the invention, which is defined in the appended claims. The fire extinguishing system according to the invention can, besides the above mentioned applications, be used in factory halls of various kinds and also in old people's homes and churches.

We claim:

1. A system for extinguishing a fire in a confined space containing at least one object in or on which the fire may occur, said system comprising:

at least one of: a plurality of general nozzles to spray into said space for bringing about general fire extinguishment in said space; and a plurality of spot nozzles disposed around said at least one object for extinguishing the fire on or in said object; and extinguishing liquid supplied to said nozzles to be sprayed thereby, including 0.5–1.5% of a reignition-preventing substance;

wherein at least one of said nozzles comprises a low-pressure nozzle for spraying the extinguishing liquid in a fog spray substantially about an axis outwardly of said low-pressure nozzle at a pressure of less than twelve bar, and said low-pressure nozzle comprising guide wings for guiding said fog spray out of said low-pressure nozzle and rotating said fog spray substantially about said axis, said fog spray having a periphery and an interior with drops of the extinguishing liquid having relatively large diameters distributed in a greater frequency at said periphery than in said interior, and with drops of the extinguishing liquid having relative smaller diameters distributed in a greater frequency in said interior than at said periphery.

2. A system as recited in claim 1 wherein both said plurality of general nozzles and said plurality of said spot nozzles are disposed in said confined space.

3. A system as recited in claim 2 wherein the extinguishing liquid sprayed by said nozzles comprises substantially salt-free extinguishing water with 0.5–1.5% of the reignition-preventing substance.

4. A system as recited in claim 2 wherein said relatively large diameter drops have a median diameter at least 20% greater than a median diameter of said relatively smaller diameter drops.

5. A system as recited in claim 4 wherein said drops have a median diameter between 0.1–0.5 mm.

6. A system as recited in claim 1 wherein said relatively large diameter drops have a median diameter at least 50% greater than the median diameter of said relatively smaller diameter drops.

7. A system as recited in claim 6 wherein both said plurality of general nozzles and said plurality of spot nozzles are disposed in said confined space.

8. A system as recited in claim 1 wherein said at least one object comprises a plurality of objects; and wherein a plurality of the spot nozzles are associated with each of said objects.

9. A system as recited in claim 8 wherein the fire inside said confined space has a vacuum side of flames produced by the fire; and wherein said low-pressure nozzles is stationary within said confined space to spray the fog spray so that the extinguishing liquid therefrom is sucked from said fog spray into the flames.

10. A system as recited in claim 1 wherein said nozzles comprise only the plurality of spot nozzles.

11. A system as recited in claim 1 wherein said nozzles comprise only the plurality of general nozzles.

12. A system as recited in claim 1 wherein said confined space comprises a ship engine room, and wherein said at least one object comprises at least one ship engine.

13. A method of extinguishing a fire in a confined space containing at least one object in or on which the fire may occur, with at least one of: a plurality of general nozzles to spray into the confined space for bringing about general fire extinguishment in the space; and a plurality of spot nozzles disposed around the at least one object for extinguishing the fire on or in the object, at least two of the nozzles comprising low-pressure nozzles, said method comprising the steps, when the fire occurs, of:

(a) supplying extinguishing liquid including 0.5–1.5% of a reignition preventing substance to the low pressure nozzles, at a pressure of between 2–12 bar; and (b) issuing a fog spray of the extinguishing liquid from the low pressure nozzles rotating about an axis extending outwardly from the nozzles, the fog spray having a periphery and an interior with drops of the extinguishing liquid having relatively large diameters distributed in a greater frequency at the periphery than in the interior, and with drops of the extinguishing liquid having relative smaller diameters distributed in a greater frequency in the interior than at the periphery.

14. A method as recited in claim 13 wherein both general nozzles and spot nozzles are disposed within the confined space; and wherein step (a) is practiced by supplying the extinguishing liquid to both the general nozzles and the spot nozzles.

15. A method as recited in claim 14 wherein step (a) is practiced by supplying substantially salt free water including 0.5–1.5% of a reignition preventing substance as the extinguishing liquid.

16. A method as recited in claim 14 wherein step (b) is further practiced to supply the extinguishing liquid to the fire at the rate of about 4–16 l/min from the spot nozzles, and at the rate of about 3–18 l/min from the general nozzles.

17. A method as recited in claim 13 wherein step (b) is practiced so that the relatively large diameter drops have a median diameter at least 20% greater than a median diameter of said relatively smaller diameter drops, the extinguishing liquid drops having a median diameter of between 0.1–0.5 mm.

18. A method as recited in claim 13 wherein step (b) is practiced so that the relatively large diameter drops have a median diameter at least 50% greater than a median diameter of the relatively smaller diameter drops.

19. A method as recited in claim 13 wherein the at least one object comprises a plurality of objects; and wherein a plurality of the spot nozzles are associated with each of the objects; and wherein step (a) is practiced by supplying the extinguishing liquid to all of the spot nozzles at a pressure of about 2–12 bar, and wherein the spot nozzles are spaced a distance of between 0.5–1.5 m from the objects in the confined space.

20. A method as recited in claim 13 wherein the fire inside the confined space has a vacuum side of flames produced by the fire; and wherein the low pressure nozzles are stationary within the confined space to spray the fog spray so that the extinguishing liquid therefrom is sucked from the fog spray into the flames; and wherein step (b) is practiced to spray the fog spray into the confined space so that the extinguishing liquid is sucked from the fog spray into the flames.

* * * * *